US005667215A

United States Patent [19]

Yoshino

[11] Patent Number: 5,667,215

[45] Date of Patent: Sep. 16, 1997

[54] PAPER CONVEYING DEVICE

[75] Inventor: Tsutomu Yoshino, Kanagawa-ken, Japan

[73] Assignee: Kabushiki Kaisha Toshiba, Kawasaki, Japan

[21] Appl. No.: 524,516

[22] Filed: Sep. 7, 1995

[30] Foreign Application Priority Data

Sep. 16, 1994 [JP] Japan ..... 6-221628

[51] Int. Cl.[6] ..... B65H 7/02

[52] U.S. Cl. ..... 271/258.01; 271/259; 271/258.03; 271/258.04; 271/110

[58] Field of Search ..... 271/258.04, 258.01, 271/258.03, 259, 265.01, 265.02, 10.02, 10.03, 4.02, 4.03, 110, 111

[56] References Cited

U.S. PATENT DOCUMENTS 5,342,037 8/1994 Martin ..... 271/111

FOREIGN PATENT DOCUMENTS 2-144348 6/1990 Japan .

3-42447 2/1991 Japan .

*Primary Examiner*—David H. Bollinger

*Attorney, Agent, or Firm*—Foley & Lardner

[57] ABSTRACT

A paper conveying device of the present invention includes a roller to convey paper, a first and a second sensors to detect the paper conveyed through the roller and a timer to measure a time required from the time when the first sensor detects the paper until the second sensor detects the paper. It is judged whether the time measured by the timer is exceeding a prescribed set value and based on this judging result, the number of times exceeding the prescribed set value is counted by a counter and the life of the roller is judged based on the counted number of times exceeding the prescribed set value.

9 Claims, 7 Drawing Sheets

PAPER CONVEYING DEVICE

BACKGROUND OF THE INVENTION

1. Field of the Invention

The present invention relates to a paper conveying device for feeding paper by rotating rollers.

2. Description of the Related Art

An image forming apparatus, for instance, a copying machine takes out paper stacked in a paper supply cassette one sheet at a time with a pick-up roller by rotating it, supplies it by rotating a feed roller to aligning rollers provided in front of a photosensitive drum and keeps it waiting there. The paper being waiting is then fed to the photosensitive drum by the rotation of the aligning rollers timed with the rotation of the photosensitive drum.

The pick-up roller and the feed roller are kept contact with the surface of the paper and supply the paper by the friction of the contacting surfaces of the rollers. Therefore, the contacting surfaces of the rollers are gradually worn out with the increase in the number of sheets supplied and lastly, the paper supply capacity will drop. The excessively worn rollers must be changed with new rollers.

As a technique to detect the timing for exchanging the rollers, some methods are disclosed in the Japanese Patent Disclosures (Kokai) No. 2-37141(U), No. 3-56734(U) and No. 4-251042(P). These methods are to detect the exchanging times of rollers by measuring a length of time of paper to arrive a prescribed position after starting the paper supply.

However, in the case of a method to detect an exchanging time of a roller by measuring a length of paper conveying time as described above, for a temporary extended paper conveying time, which may result if extremely slippery paper is mixed, may be detected erroneously to be a roller exchange time.

SUMMARY OF THE INVENTION

It is an object of the present invention to provide a paper conveying device which is capable of judging the timing for exchanging rollers precisely without being affected by a temporary extended paper conveying time.

According to the present invention, there is provided paper conveying device comprising roller means for conveying paper, first and second sensor means for sequentially detecting the paper conveyed through the roller means, means for measuring a time required from the time when the first sensor means detects the paper until the second sensor means detects the paper, first judging means for judging whether the time measured by the measuring means is in excess of a prescribed set value, means for counting the number of times exceeding the prescribed set value as judged by the first judging means, and second judging means for judging the life of the roller means based on the number of times exceeding the prescribed set value as counted by the counting means.

DETAILED DESCRIPTION OF THE PREFERRED EMBODIMENTS

The first embodiment of the paper conveying device of the present invention will be explained with reference to the drawings in the following.

Figure 1:
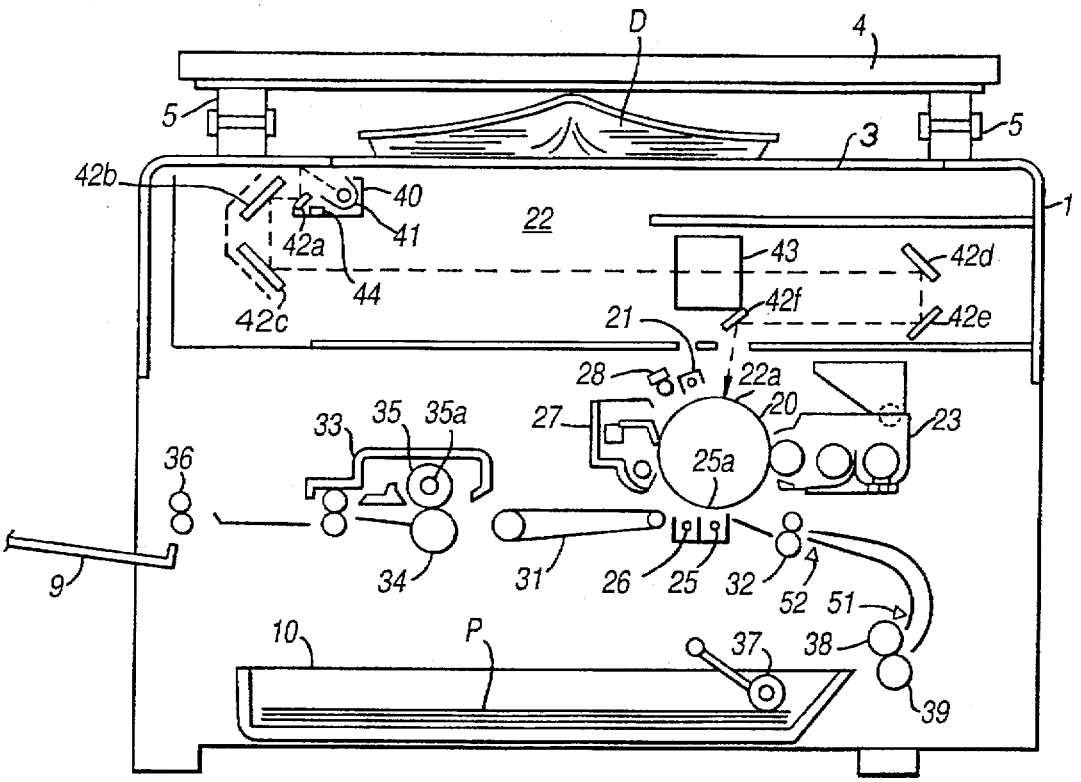
FIG. 1 is a cross-sectional view showing the whole internal structure of an image forming apparatus equipped with a paper conveying device of the present invention.

FIG. 1 shows the internal structure of the image forming apparatus equipped with the paper conveying device, for instance, a copying machine. The copying machine equips with an original table 3 provided on the top of a main body 1 and an original cover 4 at the position corresponding to the original table 3.

The original table 3 is equipped with an indicator unit (not shown) at the position adjacent to it. This indicator unit has the scale corresponding to original in various sizes on the top. The original cover 4 is mounted to the main body 1 by expansion type hinges 5 and its position is variable in the vertical direction according to a thickness of an original D which is placed on the original table 3.

Almost at the center in the main body 1, a photosensitive drum 20 is provided in the freely rotating state. There are a charger 21, an exposure portion 22*a*, a developing device 23, a transfer charger 25, a separation charger 26, a cleaner 27 and a discharger 28 provided in order around the photosensitive drum 20.

An exposure system 22 is provided at the upper part in the main body 1. The exposure system 22 comprises an exposure lamp 41, a first, a second and a third reflection mirrors 42*a*, 42*b* and 42*c*, a variable magnification lens block 43, a fourth, a fifth and a sixth reflection mirrors 42*d*, 42*e* and 42*f*.

The exposure lamp 41 is mounted on a carriage 40 which is able to reciprocate freely along the original table 3. As the carriage 40 moves in the right direction in the figure and the exposure lamp 41 flashes, the exposure scanning is carried out over the whole surface of the original table 3. A reflected light image corresponding to an image on the original D is obtained by this exposure scanning and is projected to the exposure portion 22*a* by the reflection mirrors 42*a* to 42*f* and the variable magnification lens block 43.

There is a paper supply cassette 10 provided on the bottom of the main body 1 and a pick-up roller 37 is provided for taking out paper therefrom. Paper P is taken out separately from respective paper supply cassettes by feed roller 38 and a separation roller 39 which is paired with the feed roller 38 and sent to an aligning roller pair 32, where they wait the rotation of the photosensitive drum 20.

The charger 21 applies high voltage supplied from a high voltage power source (not shown) to the photosensitive drum 20 to charge the surface of the photosensitive drum 20 with electrostatic charge. By this charging and the image formation on the photosensitive drum 20 from the exposure system 22, an electrostatic latent image is formed on the photosensitive drum 20.

The electrostatic latent image formed on the photosensitive drum 20 is developed when a developer is applied at the developing device 23 and moved to the transfer charger 25. Paper P is supplied to the transfer charger 25 from the aligning roller pair 32 in synchronization with the rotation of the photosensitive drum 20 and the developed image on the photosensitive drum 20 is transferred onto the paper P.

The paper P with the image transferred is separated from the photosensitive drum 20 by the separation charger 26 and is conveyed to a press roller 34 and a heat roller 35 of a fixer 33 by a conveyor belt 31. The heat roller 35 has a built-in heater lamp 35*a* for heating the heat roller 35. The fixed paper P is ejected in a receiving tray 9 by an exit roller 36. Further, after completing the image transfer, the photosensitive drum 20 is cleaned and discharged by the cleaner 27 and the discharger 28 and is prepared for next copying.

On the other hand, a first sensor (an after-separation sensor) 51 is provided for detecting paper P at the starting position of the paper conveying path extending from the feed roller 38 and the separation roller 39 to the aligning roller pair 32 (at the position near both rollers).

And, at the ending position of this paper conveying path, that is, at the position near the aligning roller pair 32, a second sensor (a before-aligning sensor) 52 is provided for detecting paper P.

Figure 2:
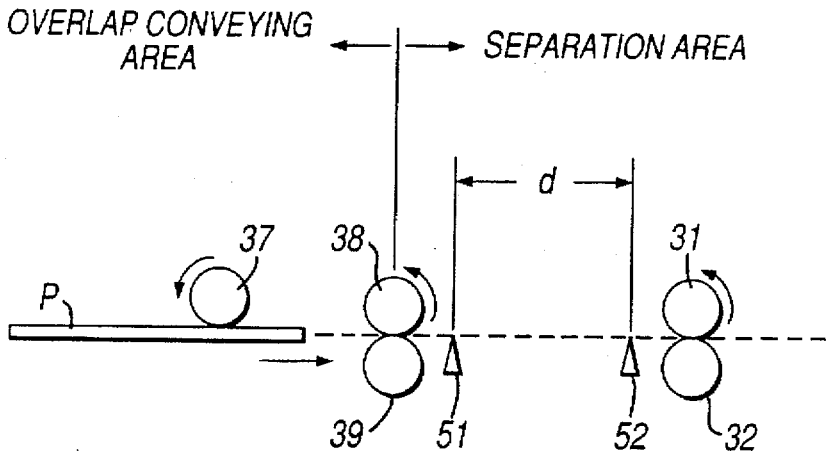
FIG. 2 is a schematic view showing the structure of sensors and peripheral parts of the paper conveying device of the present invention.

The construction of the first and second sensors 51 and 52 and their peripheral portions is shown in FIG. 2. That is, the conveying system is divided into two areas, that is, an overlap conveying area and a separation area, bounded by the positions of the feed roller 38 and the separation roller 39, and the first and second sensors 51 and 52 are provided in this separation area aparting each other by a distance of d (mm).

Figure 3:
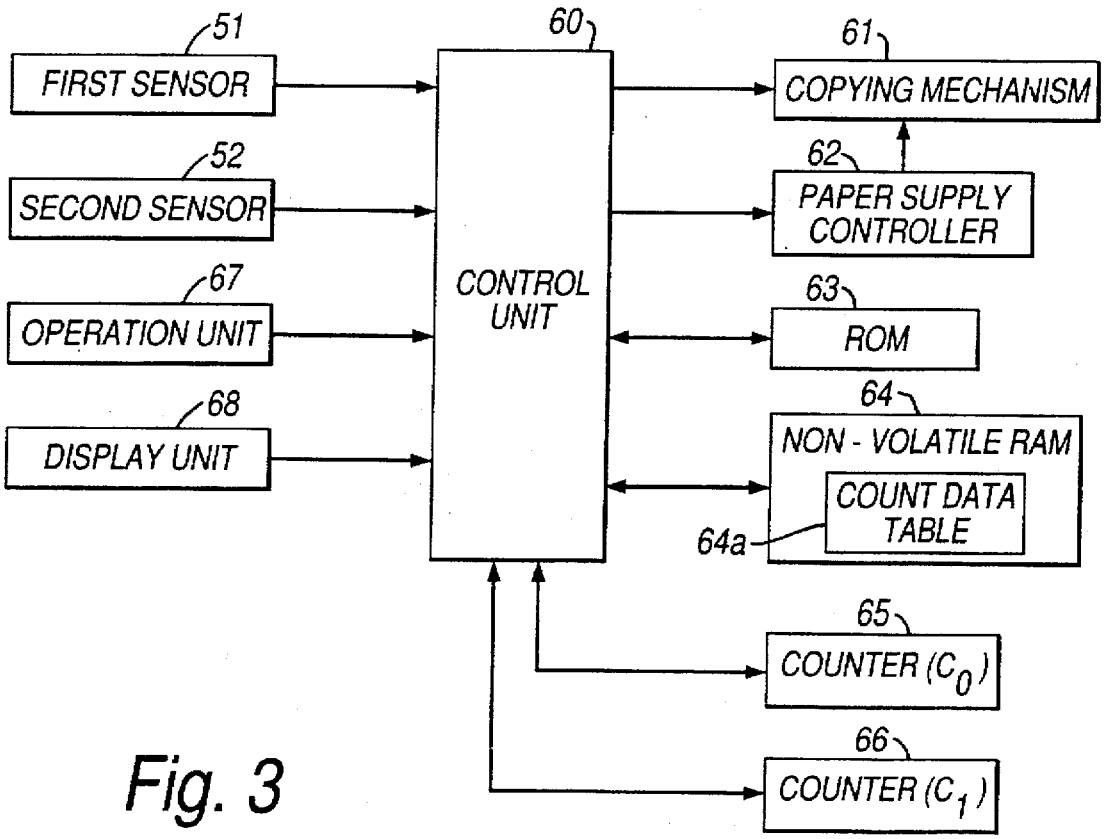
FIG. 3 is a block diagram showing a control circuit in the image forming apparatus equipped with the paper conveying device of the present invention.

Next, the principal parts of the control circuit are shown in FIG. 3.

A control unit 60 which controls the entirety of the copying machine is connected with a copying mechanism 61, a paper supply controller 62, a ROM 63, a non-volatile RAM 64, a counter($C_O$) 65, a counter($C_1$) 66, an operation unit 67, a display unit 68, the first sensor 51 and the second sensor 52.

The copying mechanism 61 drives various devices relative to the copying operation in the main body 1. The paper supply controller 62 controls the devices of the paper supply system of the copying mechanism 61. The ROM 63 stores a control program. The non-volatile RAM 64 used for tentative memory of control data and includes count data table 64*a* shown in FIG. 5B. The counter($C_O$) 65 counts the total number of sheets $C_O$ supplied from the paper supply cassette 10. The counter($C_1$) 66 and the count data table 64*a* are used for judging and controlling the service life of the rollers. The operation unit 67 is used to input various operating conditions concerning the copying. The display unit 68 displays various information concerning the copying and judging results on the service life of rollers.

The control unit 60 has principal functional means [1] through [5] as shown below:

[1] A measuring means to measure a time t from the detecting of paper P by the first sensor 51 detects paper P to the detecting of paper P by the second sensor 52.

[2] A judging means to judge whether the measured time t is in excess of the first set value $t_1$ (a time of the standard value $t_0$ with a margin added) longer than the standard value $t_0$ (a time needed when paper P in a prescribed length was conveyed by the rollers at a prescribed conveying speed).

[3] A counting means to count the number of times in which the measured time t exceeds the first set value $t_1$.

[4] A judging means to judge the service life of the feed roller 38 and other rollers in the vicinity based on the number of times counted by the counting means. Concretely, the control unit 60 has a computing means to obtain a ratio of a fixed number of supplied papers that exceeded the first set value $t_1$ based on the judgment shown in [2] above and judges the service life of the feed roller 38 and other rollers in the vicinity by comparing the computing result of the computing means with a prescribed number of times (for instance, the number of times judged to be the end of service life of rollers from test data).

[5] An indicating means to inform the result of the judgment on the life of the rollers by displaying it on the display unit 68.

Figure 4:
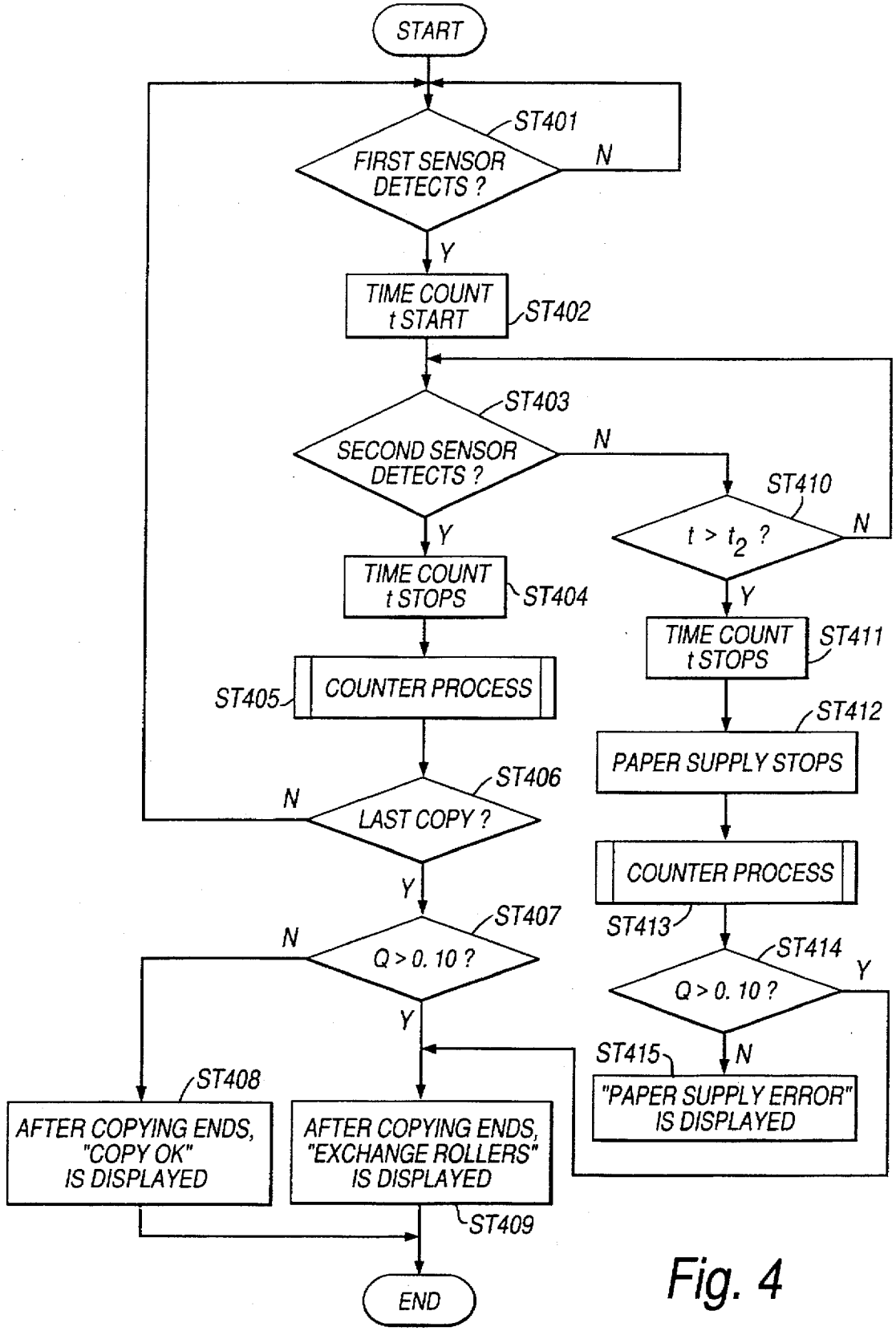
FIG. 4 is a flowchart for explaining the operation of a first embodiment of the present invention.

Next, the operation of the present invention will now be described referring to the flowchart shown in FIG. 4.

Plural sheets of paper P taken out of the supply paper cassette 10 by the contact and rotation of the pick-up roller 37 are sent to the feed roller 38, where they are separated to one sheet by the separation roller 39. The separated paper P is sent to the separation area by rotating the feed roller 38 and detected by the first sensor 51 (ST401). When the paper P is detected in Step ST401, the time count t starts (ST402).

When the first sensor 51 detects the paper P, if the second sensor 52 has detected the paper, it is judged that there is a preceding paper in the conveying path and the feed roller 38 discontinues to rotate and the paper P is kept tentatively at the position of the first sensor 51. Thereafter, if the second sensor 52 no longer detects a preceding paper, judging that there is no preceding paper in the conveying path, the feed roller 38 resumes to rotate and the paper P tentatively suspended is conveyed toward the aligning roller pair 32.

When the paper P is detected by the second sensor 52 (ST403), the paper supply by the feed roller 38 is continued for a distance from the position of the second sensor 52 to the aligning roller pair 32 and the deflection of paper and then, the feed roller 38 stops to rotate.

Thereafter, the aligning roller pair 32 rotates while timed with the rotation of the photosensitive drum 20 and the paper P kept waited is supplied to the photosensitive drum 20.

Here, when considering a time required for the paper P supplied by the feed roller 38 to arrive at a prescribed position, there are characteristics as shown below:

[1] For a short period, a required time varies depending upon "fluctuation" of the friction between the surface of the paper P and the contacting part of the feed roller 38 and the presence of friction from next paper, that is, whether next paper has arrived at the separation roller 39.

[2] For a long period, on an average a required time becomes longer than a value at the beginning including the variance in [1] above as the coefficient of friction between the surface of paper P and the contacting part of the feed roller 38 is decreased by the friction of the feed roller 38.

On the other hand, a time t from the detecting of the leading edge of the paper P by the first sensor 51 to the detecting of the leading edge of the paper P by the second sensor 52 is measured (ST404).

If the standard value $t_0$ of the paper supply speed of the feed roller 38 is assumed to be V, the standard value $t_0$ of the moving time of paper P between the sensors 51 and 52 is obtained from the following equation using a distance d (mm) between the sensors 51 and 52:

$$t_0=d/V$$

The first set value $t_1$ that is equivalent to a longer time than this standard value $t_0$, that is, this standard value $t_0$ with a margin added is stored in the ROM 63 together with a control program for judging the life of the feed roller 38. Further, the standard value $t_0$ and the second set value $t_2$ that is equivalent to a longer time than the standard value $t_0$ have been stored for sensing paper jam in the ROM 63 in addition to the control program and the first set value $t_1$.

The set value $t_2$ is a value that is the 30% increased standard value $t_0$:

$$t_2=d/(0.7\cdot V)$$

Figure 5A:
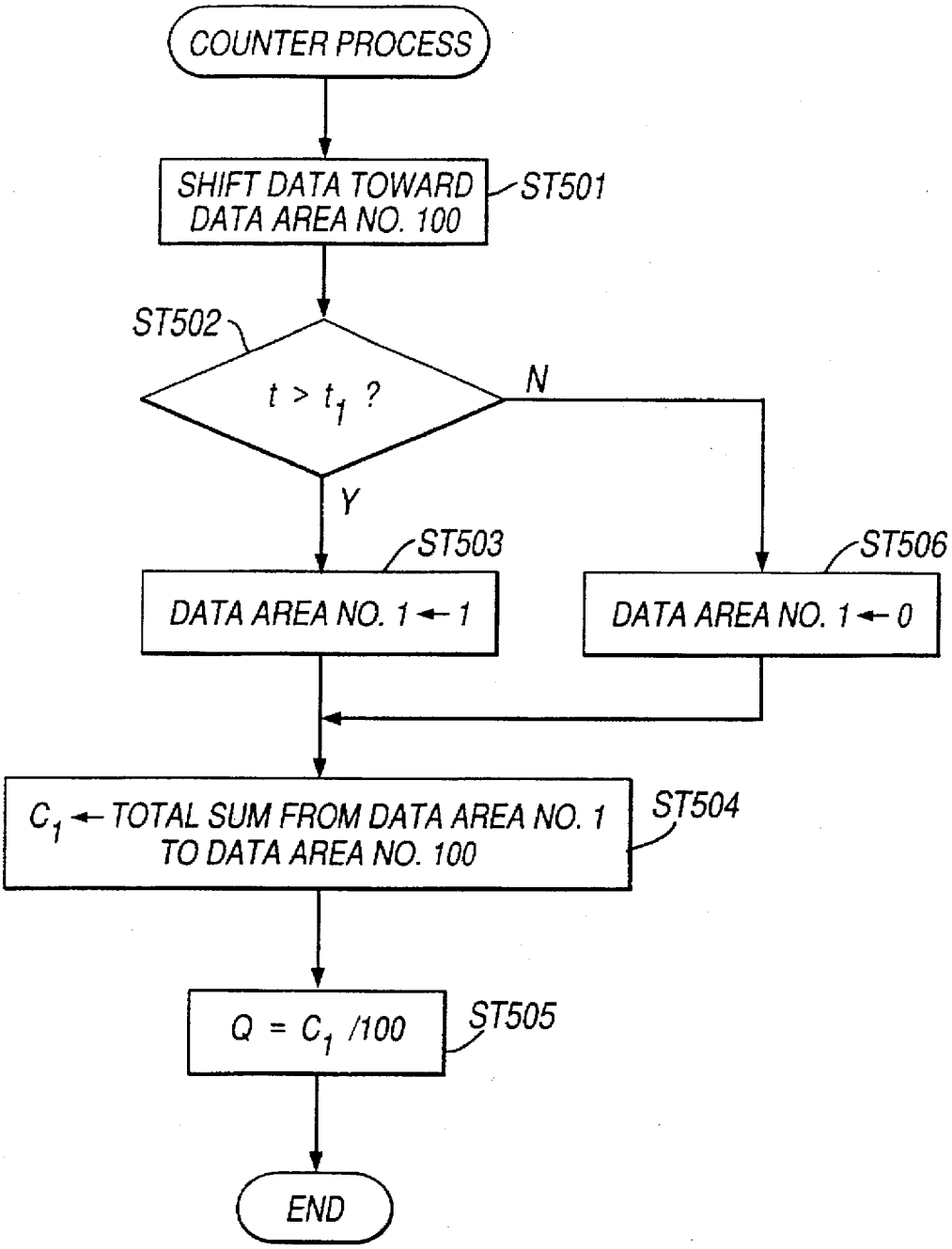
FIG. 5A is a flowchart showing the counter process.
Figure 5B:
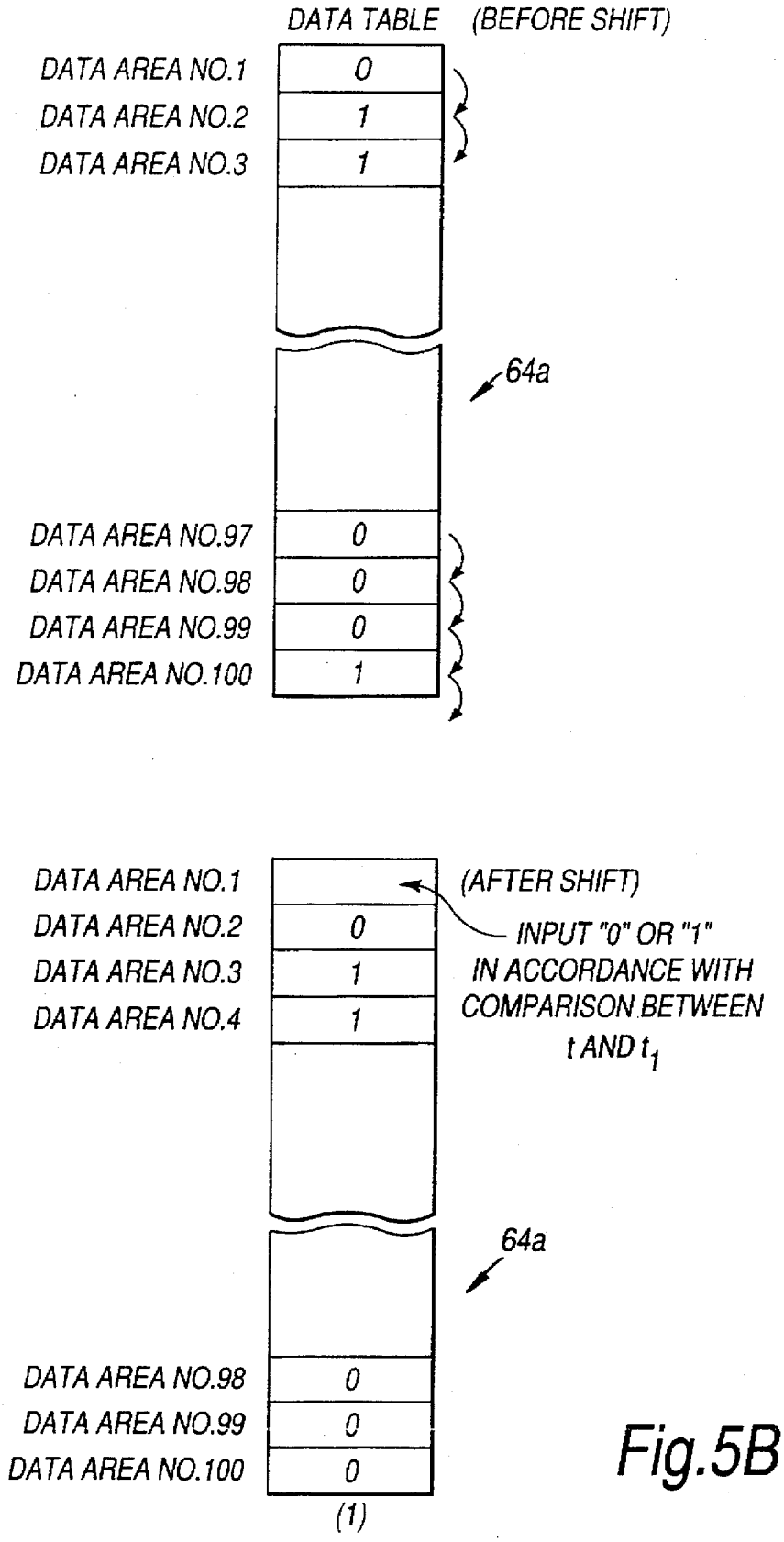
FIG. 5B is a data table for counter process.

Then a counter process starts (ST405). In this counter process, the counter($C_1$) 66 counts the number of times $C_1$ in which the measured time t exceeds the first set value $t_1$ at 100 sheets of paper fed in the past including in this time. As shown in FIG. 5B, the count data table 64*a* dividing into 100 areas as data area No.1 to data area No.100 is provided in the non-volatile RAM 64. Data "0" or "1" is stored in the data areas No.1 to No.100 in accordance with the measured time t. If the measured time t exceeds the first set value $t_1$, a data "1" is stored in the data areas No.1 to No.100 of the data table 64*a*. If the measured time t does not exceed the first set value $t_1$, a data "0" is stored in the data areas No.1 to No.100 of the data table 64*a*.

The sum total from data areas No.1 to No.100 becomes the number of times $C_1$ indicating the measured time t exceeds the first set value $t_1$ at 100 sheets of paper fed in the past.

The detail of the counter process will now be described with reference to FIG. 5A. As shown in FIG. 5B, data stored in data areas No.1 to No.100 of the data table 64*a* are shifted toward data area No.100 one by one (ST501). In this time, the data stored in data area No.100 before shifting is deleted. At that time, the number of times $C_{1\ 1}$ is counted down 1 if the stored data in data area No.100 is "1" before shifting and is not counted down if the stored data in data area No.100 is "0" before shifting. Then, it is judged whether the measured time t is above the first set value $t_1$ (ST502) and when this judgment is satisfied ($t>t_1$), data "1" is stored in the data area No.1 and as a result by the total sum obtained at a later time, the number of times $C_1$ is counted up (ST503). When the judgment is not satisfied ($t\leqq t_1$), data "0" is stored in the data area No.1 and as a result by the total sum obtained at a later time, the number of times $C_1$ is not counted up (ST506). Next, the total sum from the data area No.1 to the data area No. 100 is obtained to count the number of times $C_1$ when the measured time t exceeds the first set value $t_1$ at 100 sheets of paper fed in the past including in this time (ST504). Then, a ratio Q is calculated to collect the statistics of the number of times $C_1$ when the measured time t exceeds the first set value $t_1$ at 100 sheets of paper fed in the past including in this time as follows (ST505):

$$Q=C_1/100$$

Here, the process returns to the main routine from the subroutine for the counting. After this counter process (ST405), it is judged whether the currently set continuous copying ends (ST406), the ratio Q is compared with a standard value, for instance, "0.10" and based on the result of this comparison, the service life of the feed roller 38 is determined (ST407). When $Q\leqq 0.10$, that is, when the ratio of paper supply that becomes ($t>t_1$) is less than 10% of the fixed number of sheets (100 sheets) in the past, it is judged that the feed roller 38 is still serviceable and a sufficient paper supply capacity is available and after completing the copying of this time, the indication "COPYING OK" is displayed on the display unit 68 (ST408).

When $Q>0.10$, that is, when the ratio of paper supply that becomes ($t>t_1$) is more than 10% of the fixed number of sheets (100 sheets) in the past, it is judged that the feed roller 38 is close to the life and the paper supply capacity becomes poor and after completing the copying, the indication "EXCHANGE ROLLERS" is displayed on the display unit 68 (ST409). When this indication is displayed, operator can know that the feed roller 38 and other rollers in the vicinity are in the stage for exchange with new rollers and is able to take a proper action, for instance, to ask the exchange work to a dealer.

It is needless to say that when the rollers are exchanged with new rollers, the data table 64*a* in the nonvolatile RAM 64 will be reset.

If a measured time t has exceeded the second set value t2 when the second sensor 52 has not detected paper P after the first sensor 51 detected the leading edge of the paper P (ST410 and ST411), it is judged that the paper has jammed and the paper supply operation is stopped (ST412). In this case, after the counter process of "$C_1$" described above is executed (ST413), the indication "PAPER SUPPLY ERROR" is displayed on the display unit 68 (ST415). If the result of the counter process $Q>0.10$ (ST414), the indication "EXCHANGE ROLLERS" is displayed on the display unit 68 (ST409). Here, the counter process (ST413) is the same as the processes from ST501 through ST506 described above.

Thus, by measuring a time t from the time when the supplied paper is detected by the first sensor 51 to the time when it is detected by the second sensor 52 and judging whether the measured time t is above the first set value $t_1$, the service life of the rollers is judged based on the number of times satisfying the above judgment. Accordingly, it is possible to grasp the exchange time of the rollers precisely without being subject to the influence of a tentative extension of the conveying time when extremely slippery paper is mixed.

Figure 6:
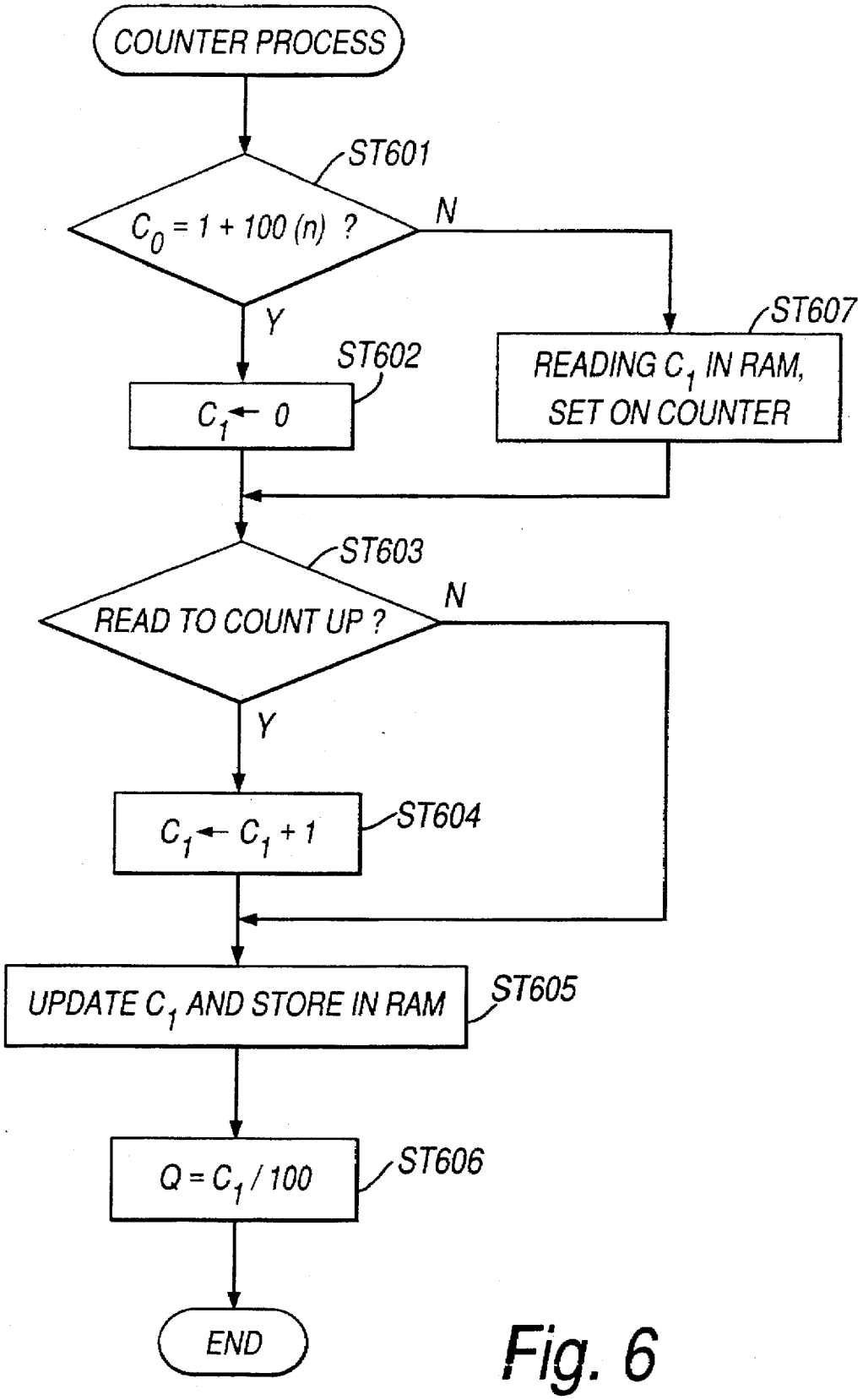
FIG. 6 is a flowchart showing a modified example of the counter process.

Further, although the statistics of paper supply of a fixed number of sheets (100 sheets) in the past are collected successively in the above, the statistics may be collected whenever the supply of a fixed number of sheets (100 sheets) was completed. The counter process routine in this case is shown in FIG. 6.

That is, in this case, regarding a count value $C_0$ of the counter 65, which is the total number of sheets supplied, whenever the condition of $C_0=1+100$ (n) is satisfied (ST601), that is, whenever the count value $C_0$ is increased for every 100 sheets, the value $C_1$ of the counter 66 is cleared (ST602). Regarding a count value $C_0$ of the counter 65, which is the total number of sheets supplied, when the condition of $C_0=1+100$ (n) is not satisfied, $C_1$ in the RAM 64 is read out and set in the counter 66 (ST607). Then, if the count-up is required (ST603), the value $C_1$ of the counter 66 is counted up by "1" (ST604).

The incremented value $C_1$ of the counter 66 is updated and stored in the dedicated address of the RAM 64 (ST605) and a ratio Q of the supply of a fixed number of sheets (100 sheets) in the past satisfying the above judgment is obtained by the following calculation using the value $C_1$ (ST606):

$$Q=C_1/100$$

Next, the second embodiment of the present invention will be explained.

In this embodiment, the control unit 60 has [1] through [3] shown below as the principal functional means. All others are in the same construction as the first embodiment.

[1] A control means to perform the resupply of paper, that is, the so-called retry of paper supply by rotating the pick-up roller 37 again, which was once stopped, if the first sensor 51 does not detect paper P within a fixed time $t_P$ after the paper supply by the pick-up roller 37 was started.

[2] A judging means to judge the life of the pick-up roller 37 and other rollers in the vicinity based on the number of sheets retried to supply. Concretely, the control unit 60 has a computing means to obtain a ratio of the retried paper supply to a fixed number of sheets supplied and the life of the pick-up roller 37 and other rollers in the vicinity is judged by comparing the computing result of the computing means with a reference value.

[3] A means to inform by displaying the result of judgment regarding the life of the rollers on the display unit 68.

Figure 7:
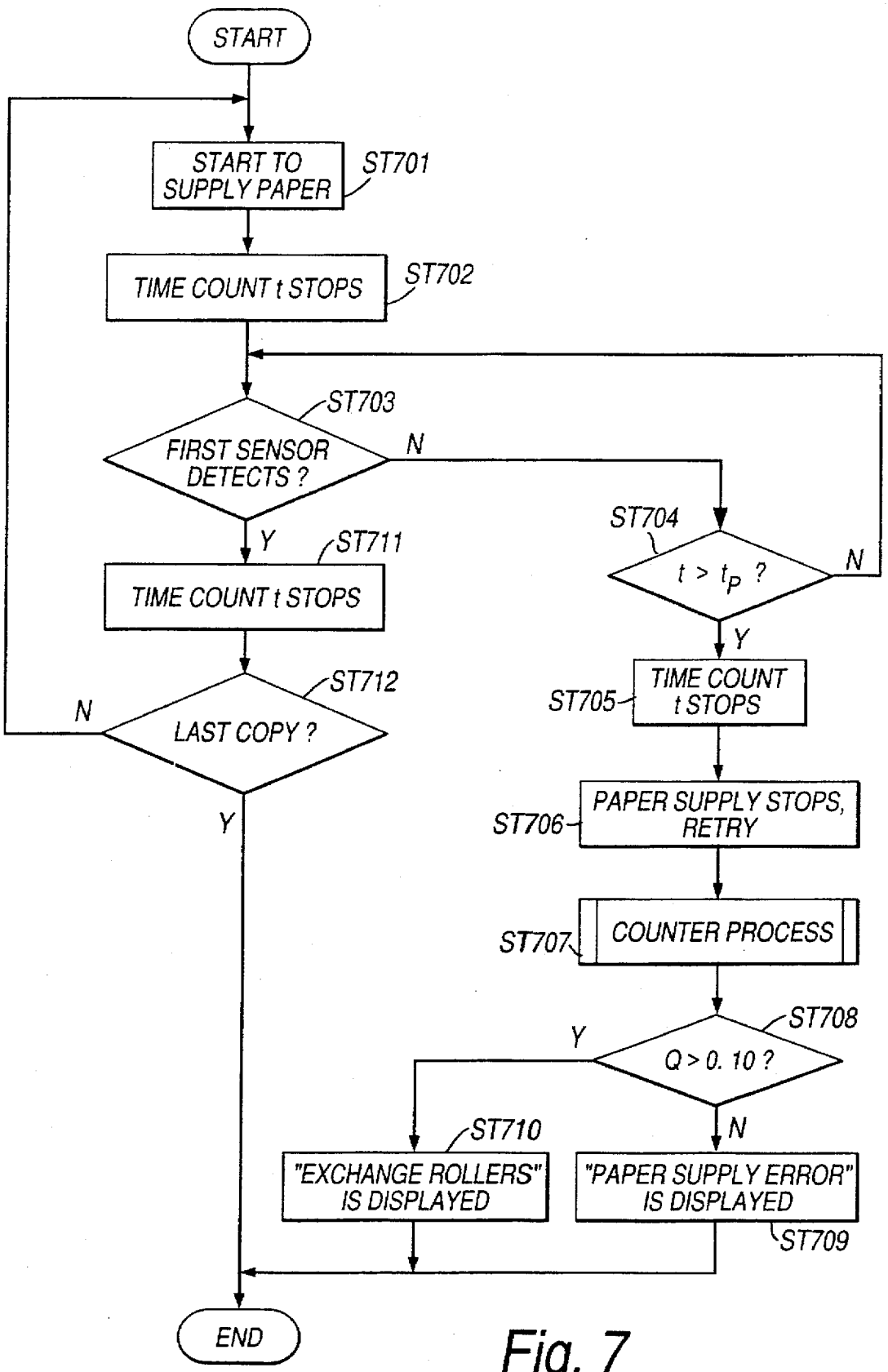
FIG. 7 is a flowchart for explaining the operation of a second embodiment of the present invention.

Next, the operation of the apparatus in the construction as described above will now be explained referring to the flowchart shown in FIG. 7.

When the paper supply is started by rotating the pick-up roller 37 (ST701), the time count t starts (ST702).

Then, it is judged whether the first sensor 51 detects the leading edge of paper P (ST703). A prescribed time $t_P$, which is a set value for the retry of paper supply, is stored together with a control program in the ROM 63 and if the time count t exceeds the prescribed time $t_P$ while the first sensor 51 does not detect the leading edge of the paper P (ST704), the time count t stops (ST705) and the pick-up roller 37 is once stopped. Then, the pick-up roller 37 is again rotated and the retry of paper supply is carried out (ST706).

In general, the frictional force of roller against the surface of paper P is divided into two: dynamic frictional force and static frictional force and they are in the relationship of dynamic frictional force<static frictional force. This is so even when the frictional force is reduced as a roller is worn away. Taking this relationship between the dynamic frictional force and the static frictional force into consideration, the pick-up roller 37 once stopped is rotated again and by retrying the paper supply using the larger static frictional force, the paper supply error is relieved.

To take the statistics regarding the number of paper supply retried, the data are input into the count data table 64*a* in the RAM 64 (ST707). The routine of this counter process is the same as that shown in Steps ST501 through ST506 for the first embodiment shown in FIG. 5 and the number of paper supply retried is counted by the counter process. The ratio Q of the paper supply retried to a fixed number of sheets (100 sheets) supplied in the past is obtained according to the following computation using the counter process:

$$Q=C_1/100$$

After this counter process, the ratio Q is compared with a standard value, for instance, "0.10" and from the result of this comparison, the life of the pick-up roller 37 is judged (ST708). As the result of judgment in Step ST708, if $Q \leqq 0.10$, that is, the ratio of the paper supply retried is less than 10% of a fixed number of sheets (100 sheets) supplied in the past, it is judged that the pick-up roller 37 is still serviceable and a sufficient paper supply capacity is available, and after completing the current copying, the indication "PAPER SUPPLY ERROR" only is displayed on the display unit 68 (ST709) and nothing else is displayed regarding the exchange of rollers.

When $Q>0.10$, that is, if a ratio of the paper supply retried is more than 10% of a fixed number of sheets (100 sheets) supplied in the past, it is judged that the pick-up roller 37 becomes close to the end of life and its paper supply capacity becomes poor, and after completing the current copying, the indication "EXCHANGE ROLLERS" is displayed on the display unit 68 (ST710). From this indication, operator can know that the pick-up roller 37 and other rollers in the vicinity are in the stage for exchanging and is able to take a proper action, for instance, to ask the exchange work to a dealer.

When the first sensor 51 detects the leading edge of paper P in Step ST703, the time count t is stopped (ST711), it is judged whether the copying of the last sheet is completed (ST712) and if not, the processes from Step ST701 described above are carried out repeatedly.

As described above, the life of rollers is judged from the statistics of the number of paper supplies retried and it is therefore possible to precisely grasp the timing for exchanging the rollers without being subject to the influence of tentative extension of a conveying time when extremely slippery paper P is mixed.

Further, although the statistics are taken in order regarding a fixed number of sheets (100 sheets) supplied in the above, the statistics may be taken whenever the paper supply in a fixed number of sheets (100 sheets) is completed. The counter process routine in this case is the same as that shown in FIG. 6.

Further, although the standard value to the ratio Q is set at "0.10" in the embodiments described above, this value may be set as appropriate according to diameters and materials of the rollers.

As described above, the present invention makes it possible to precisely grasp the timing for exchanging the rollers without being subject to the influence of tentative extension of a conveying time.

The present invention is applicable in various other forms without departing from the spirit or essential characteristics thereof. Therefore, the embodiments described above are merely examples in all points and shall not be restrictively construed. The scope of the invention is defined by the appended claims and is not restricted by the specification thereof. Further, all deformations and changes that fall within the equivalence of the claims are therefore intended to be embraced by the claims.

What is claimed is:

1. A paper conveying device comprising:

roller means for conveying paper;

first and second sensor means for sequentially detecting the paper conveyed through the roller means;

means for measuring a time required from the time when the first sensor means detects the paper until the second sensor means detects the paper;

first judging means for judging whether the time measured by the measuring means is in excess of a prescribed set value;

means for counting the number of times exceeding the prescribed set value as judged by the first judging means; and second judging means for judging the life of the roller means based on the number of times exceeding the prescribed set value as counted by the counting means.

2. The device according to claim 1, wherein the prescribed set value is a time required to convey the paper between the first and second sensor means with paper conveying speed of the roller means.

3. The device according to claim 1, wherein the roller means includes a pick-up roller to take out a sheet of paper from stocked plural sheets of paper.

4. A paper conveying device comprising:

roller means for conveying paper;

means for measuring a time required to pass the paper through the roller means;

means for comparing the time measured by the measuring means with a prescribed set value;

means for counting the number of times that the time compared by the comparing means exceeds the prescribed set value; and means for judging the life of the roller means based on the number of times exceeding the prescribed set value as counted by the counting means.

5. A paper conveying device comprising:

roller means for conveying paper;

first and second sensor means for sequentially detecting the paper passed through the roller means;

means for measuring a time required from the time when the first sensor detects the paper until the second sensor detects the paper;

first judging means for judging whether the time measured by the measuring means exceeds a prescribed set value;

means for computing a ratio of the number of the measured times exceeding the set value to a fixed number of sheets of paper conveyed as a result of the judgment made by the first judging means;

second judging means for judging the life of the roller means based on the result of computation made by the computing means; and means for informing the result of judgment made by the second judging means.

6. The device according to claim 5, wherein the second judging means includes memory means for storing a reference value and means for comparing the result of computation made by the computing means with the reference value stored in the memory means, and the life of the roller means is judged when the result of computation exceeds the reference value.

7. A paper conveying device comprising:

roller means for conveying paper;

sensor means provided at down stream of conveying direction of the paper for detecting the paper passed through the roller means;

means for controlling the roller means to stop the operation of the roller means when the sensor means does not detect the paper within a fixed time after starting the paper conveying then restart the operation of the roller means to convey the paper; and means for judging the life of the roller means based on the number of times to restart the operation of the roller means.

8. A paper conveying device comprising:

roller means for conveying paper;

sensor means provided at down stream of conveying direction of the paper for detecting the paper passed through the roller means;

means for controlling the roller means to stop the operation of the roller means when the sensor means does not detect the paper within a fixed time after starting the paper conveying then restart the operation of the roller means to convey the paper;

means for computing a ratio of the number of times to restart the operation of the roller means to a fixed number of sheets of paper conveyed;

means for judging the life of the roller means based on the result of computation made by the computing means; and means for informing the result of judgment made by the judging means.

9. The device according to claim 8, wherein the judging means includes memory means for storing a reference value and means for comparing the result of computation made by the computing means with the reference value stored in the memory means, and the life of the roller means is judged when the result of computation exceeds the reference value.

* * * * *